US008907191B2

(12) United States Patent
Seese, Jr. et al.

(10) Patent No.: US 8,907,191 B2
(45) Date of Patent: Dec. 9, 2014

(54) MUSIC APPLICATION SYSTEMS AND METHODS

(71) Applicant: Mowgli, LLC, Atlanta, GA (US)

(72) Inventors: Marshall Seese, Jr., Alanta, GA (US); Michael VanBeneden, Atlanta, GA (US); Adam Kunz, Atlanta, GA (US)

( * ) Notice: Subject to any disclaimer, the term of this patent is extended or adjusted under 35 U.S.C. 154(b) by 136 days.

(21) Appl. No.: 13/648,160

(22) Filed: Oct. 9, 2012

(65) Prior Publication Data

US 2013/0269504 A1 Oct. 17, 2013

Related U.S. Application Data

(60) Provisional application No. 61/544,881, filed on Oct. 7, 2011.

(51) Int. Cl.
*G10H 7/00* (2006.01)
*G10H 1/00* (2006.01)

(52) U.S. Cl.
CPC ..... *G10H 1/0025* (2013.01); *G10H 2220/126* (2013.01); *G10H 2240/181* (2013.01); *G10H 2210/125* (2013.01); *G10H 2250/641* (2013.01)
USPC ..... 84/603; 84/609; 84/610; 84/615; 84/634; 84/639; 84/650; 84/653; 84/666

(58) Field of Classification Search
CPC ..... G10H 1/0025; G10H 2210/076; G10H 2240/175; G10H 2240/325; G10H 2240/131; G10H 2220/135; G10H 2210/125; G10H 1/365; G10H 2240/135; G10H 2210/091; G10H 2220/081; G10H 2250/641; G10H 2210/026
See application file for complete search history.

(56) References Cited

U.S. PATENT DOCUMENTS

| | | | | |
|---|---|---|---|---|
| 6,888,999 | B2 * | 5/2005 | Herberger et al. | 386/278 |
| 7,732,697 | B1 * | 6/2010 | Wieder | 84/609 |
| 7,982,121 | B2 * | 7/2011 | Randle et al. | 84/611 |
| 8,207,438 | B2 * | 6/2012 | Humphrey | 84/612 |
| 8,278,543 | B2 * | 10/2012 | Humphrey | 84/602 |
| 8,278,544 | B2 * | 10/2012 | Humphrey | 84/602 |
| 8,283,545 | B2 * | 10/2012 | Humphrey | 84/470 R |
| 2002/0166440 | A1 * | 11/2002 | Herberger et al. | 84/625 |
| 2009/0164034 | A1 * | 6/2009 | Cohen et al. | 700/94 |
| 2009/0164902 | A1 * | 6/2009 | Cohen et al. | 715/716 |
| 2010/0319517 | A1 * | 12/2010 | Savo et al. | 84/609 |
| 2010/0322042 | A1 * | 12/2010 | Serletic et al. | 369/1 |
| 2011/0179941 | A1 * | 7/2011 | Humphrey | 84/470 R |
| 2011/0179942 | A1 * | 7/2011 | Humphrey | 84/470 R |
| 2013/0220102 | A1 * | 8/2013 | Savo et al. | 84/609 |

* cited by examiner

*Primary Examiner* — Marlon Fletcher

(57) ABSTRACT

Game systems according to various embodiments are adapted to allow users to assemble an instrument performance for a particular song by: (1) displaying a music loop pallet that includes a plurality of different music loops that each contain music played by a particular musical instrument (e.g., guitar, bass, drums, piano, etc.); and (2) allowing a user to assemble the instrument performance by indicating (a) which of the plurality of music loops will be included in the instrument performance, and (b) in which order the music loops will be played during the instrument performance. In certain embodiments, the system is configured to allow a user to create songs that comprise a plurality of instruments and genres of music into one complete song.

23 Claims, 9 Drawing Sheets

MUSIC APPLICATION SYSTEMS AND METHODS

CROSS REFERENCE TO RELATED APPLICATION

This application claims priority from U.S. Provisional Patent Application 61/544,881, entitled "Game Systems and Methods", which was filed on Oct. 7, 2011, and which is hereby incorporated by reference in its entirety.

BACKGROUND

Over the past several decades, video games and other applications have become increasingly popular and have evolved to include highly sophisticated graphics, music, and game concepts. Most popular video games and applications focus on pure entertainment, keeping players busy and engaged, but offer little in the way of education.

While there are several video games and applications that do offer educational opportunities, some users may see these games as "boring", and prefer to spend most of their time playing the sophisticated games that were created purely for entertainment. Accordingly, there is a need for games and applications that tie entertainment and education together, particularly in the area of music composition.

SUMMARY OF VARIOUS EMBODIMENTS

In particular embodiments, a non-transitory computer-readable medium stores computer-executable instructions for: (A) allowing a user to build a first music track by: (1) selecting a first plurality of music loops from a first pallet of music loops for inclusion in the first music track; and (ii) specifying a sequential order in which the first plurality of music loops are to be played. In various embodiments, the non-transitory computer-readable medium further stores computer-executable instructions for allowing the user to build a second music track by: (1) selecting a second plurality of music loops from a second pallet of music loops for inclusion in the second music track; and (ii) specifying a sequential order in which the second plurality of music loops are to be played. In particular embodiments, the non-transitory computer-readable medium further stores computer-executable instructions for substantially simultaneously replaying the first and second music tracks as tracks of a particular song.

A computer system, according to various embodiments, comprises at least one process and memory. In particular embodiments, the computer system is configured for: (1) allowing a user to build a first music track by: (i) selecting a first plurality of music loops from a first pallet of music loops for inclusion in the first music track: and (ii) specifying a sequential order in which the first plurality of music loops are to be played; (2) allowing the user to build a second music track by: (i) selecting a plurality of music loops from a second pallet of music loops for inclusion in the second music track: and (ii) specifying a sequential order in which the second plurality of music loops are to be played; and (3) rendering a song based at least in part on the first music track and the second music track.

A non-transitory computer-readable medium, according to particular embodiments, stores computer-executable instructions for: (A) providing an interface to a user for allowing the user to build one or more music tracks; (2) receiving, form the user, a selection of one or more music loops for inclusion in each of the one or more music tracks; (C) sending metadata to a server, the metadata comprising the one or more music tracks; and (D) rendering a song based at least in part on the metadata.

BRIEF DESCRIPTION OF THE DRAWINGS

In the context of this disclosure, reference will be made to the accompanying drawings, which are not necessarily drawn to scale, and wherein.

DETAILED DESCRIPTION OF VARIOUS EMBODIMENTS

Figure 1:
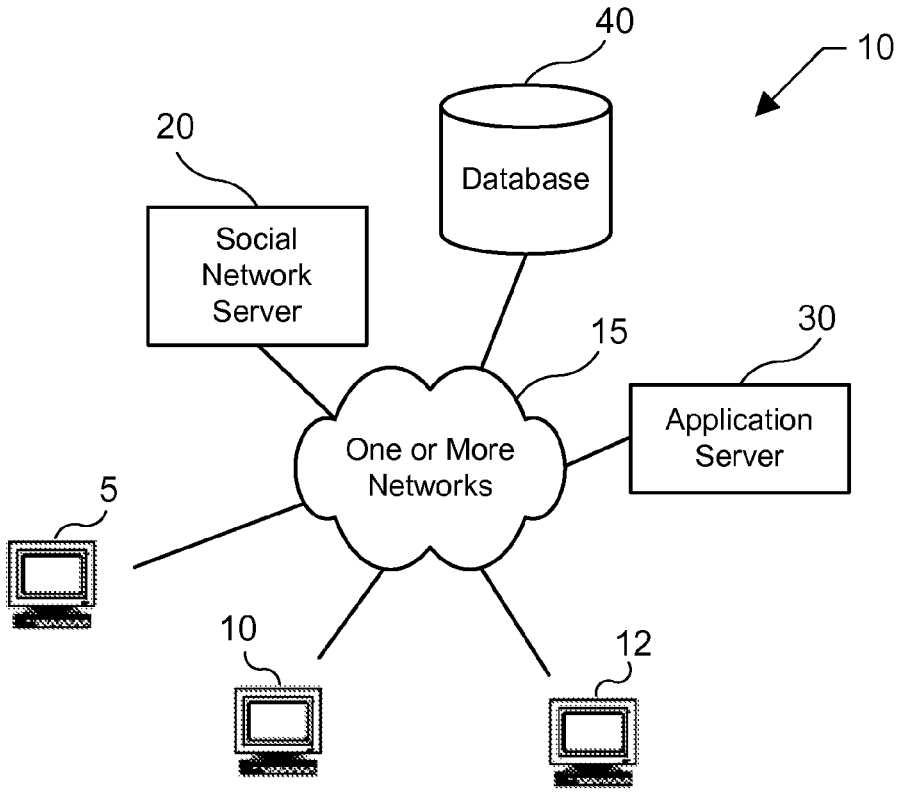
FIG. 1 is a block diagram of a Game System according to one embodiment.

Various embodiments will now be described more fully hereinafter with reference to the accompanying drawings, in which various relevant embodiments are shown. The invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Overview

Application systems according to various embodiments are adapted to allow users to assemble an instrument performance for a particular song by: (1) displaying a music loop pallet that includes a plurality of different music loops that each contain music played by a particular musical instrument (e.g., guitar, bass, drums, piano, etc.); and (2) allowing a user to assemble the instrument performance by indicating (a) which of the plurality of music loops will be included in the instrument performance, and (b) in which order the music loops will be played during the instrument performance. In certain embodiments, a game system is configured to allow a user to include a single music loop multiple times within a particular instrument performance, and may further allow the user to not use all of the available loops from the pallet in the instrument performance. In various embodiments, this may, for example, provide the user with a substantial amount of artistic freedom in assembling the instrument performance.

In various embodiments, each of the plurality of music loops in a particular pallet is of at least about the same length, contains music of at least about the same tempo, and/or contains music of the same general musical style as the other loops in the pallet. In addition, all of the music loops in a particular pallet may be configured so that a user can assemble them in any order to produce a substantially continuous, cohesive, and fluid instrument performance. This may be helpful in allowing users who are inexperienced in writing music to assemble pleasing individual instrument performances. In particular embodiments, each music loop in any particular music loop pallet includes only the music of a particular musical instrument. In other embodiments, each music loop in any particular music loop pallet includes music from a plurality of instruments as well as other sounds (e.g., drum and bass, piano and guitar, etc.).

In particular embodiments, the system is configured to allow users to use the techniques described above to assemble multiple instrument performances that may be played together simultaneously as multiple tracks of a new song. In particular embodiments, this process is facilitated by providing the user with a "song pack" that includes a plurality of pre-selected loops for each of a plurality of instruments. Each of the plurality of music loops in the song pack may be, for example, of at least about the same style and tempo of music. In addition, the music loops may be selected so that any instrumental performance created using the loops in the pallet for that particular instrument will match, in style, length, and tempo, any other possible instrumental performances created using the song pack. This may, for example, allow even inexperienced users to create new, high-quality multi-instrument songs with little training or effort.

After creating a particular song, the system may allow the user to play back ("perform") the song in a variety of different venues, and to obtain experience, feedback, and virtual rewards during the course of the performances. This may, for example, allow users to begin the game as a small, unknown band and grow in popularity and influence.

In particular embodiments, the system may be adapted to allow users to learn the basics of music composition within the context of a game. In addition, the system may be adapted to allow users to compose their own loops for use in their compositions (e.g., using real instruments or virtual instruments). Furthermore, the system may be configured to allow users to share songs that were written in the context of a particular game with individuals outside of the context of the game. In various embodiments, the game is adapted to be played on a social networking site, such as Facebook, and songs composed within the context of the game may be shared with others.

In various embodiments, the system is adapted to allow multiple users to play the game at the same time (e.g., on a performance or collaborative basis). For example, in a particular embodiment, the system is adapted to allow users to invite their friends (e.g., up to 3 or any other predetermined number of friends) to collaborate on composing a particular song. This may be done, for example, by assigning one or more particular tracks of the song to different individuals to work on. For example, a first individual may be assigned to compose the song's drum track, a second individual may be assigned to compose the song's bass track, a third individual may be assigned to compose the songs lead guitar track, etc. The friends may then work together to compose a particular song for use within the context of the game, or outside of the context of the game.

Exemplary Technical Platforms

As will be appreciated by one skilled in the relevant field in view of this disclosure, the present invention may be embodied as a method, a data processing system, or a computer program product. Accordingly, the present invention may take the form of an entirely hardware embodiment, an entirely software embodiment, or an embodiment combining software and hardware aspects. Furthermore, the present invention may take the form of a computer program product on a computer-readable storage medium having computer-readable program instructions (e.g., software) embodied in the storage medium. More particularly, the present invention may take the form of web-implemented computer software and mobile software. Any suitable computer-readable storage medium may be utilized including hard disks, DVDs, CD-ROMs, optical storage devices, flash drives, and/or magnetic storage devices.

Various embodiments of the system are described below with reference to block diagrams and flowchart illustrations of methods, apparatuses (e.g., systems) and computer program products according to a particular embodiment. It will be understood that each block of the block diagrams and flowchart illustrations, and combinations of blocks in the block diagrams and flowchart illustrations, respectively, may be implemented by computer program instructions. These computer program instructions may be loaded onto a general purpose computer, special purpose computer, or other programmable data processing apparatus to produce a machine, such that the instructions which execute on the computer or other programmable data processing apparatus create a means for implementing the functions specified in the flowchart block or blocks.

The computer program instructions may also be stored in a computer-readable memory that may direct a computer or other programmable data processing apparatus to function in a particular manner, such that the instructions stored in the computer-readable memory produce an article of manufacture including computer-readable instructions for implementing the function specified in the flowchart block or blocks. The computer program instructions may also be loaded onto a computer or other programmable data processing apparatus to cause a series of operational steps to be performed on the computer or other programmable apparatus to produce a computer-implemented process such that the instructions that execute on the computer or other programmable apparatus provide steps for implementing the functions specified in the flowchart block or blocks.

Accordingly, blocks of the block diagrams and flowchart illustrations support combinations of means for performing the specified functions, combinations of steps for performing the specified functions and program instruction means for performing the specified functions. It will also be understood that each block of the block diagrams and flowchart illustrations, and combinations of blocks in the block diagrams and flowchart illustrations, may be implemented by special purpose hardware-based computer systems that perform the specified functions or steps, or combinations of special purpose hardware and computer instructions and other hardware executing appropriate computer instructions.

Exemplary System Architecture

FIG. 1 shows a block diagram of an Application System 10 according to a particular embodiment. As may be understood from this figure, the Application System 10 includes an Application Server 30 (which may, for example, include one or more computer servers), one or more computer networks 15, a Social Network Server 20, a Database 40, and at least one user computer 5, 10, 12. The one or more computer networks 15 facilitate communication between the Social Network Server 20, the Application Server 30, the Database 40, and/or the one or more user computers 5, 10, 12. These one or more computer networks 15 may include any of a variety of types of computer networks such as the Internet, a private intranet, a public switch telephone network (PSTN), or any other type of network.

Figure 2:
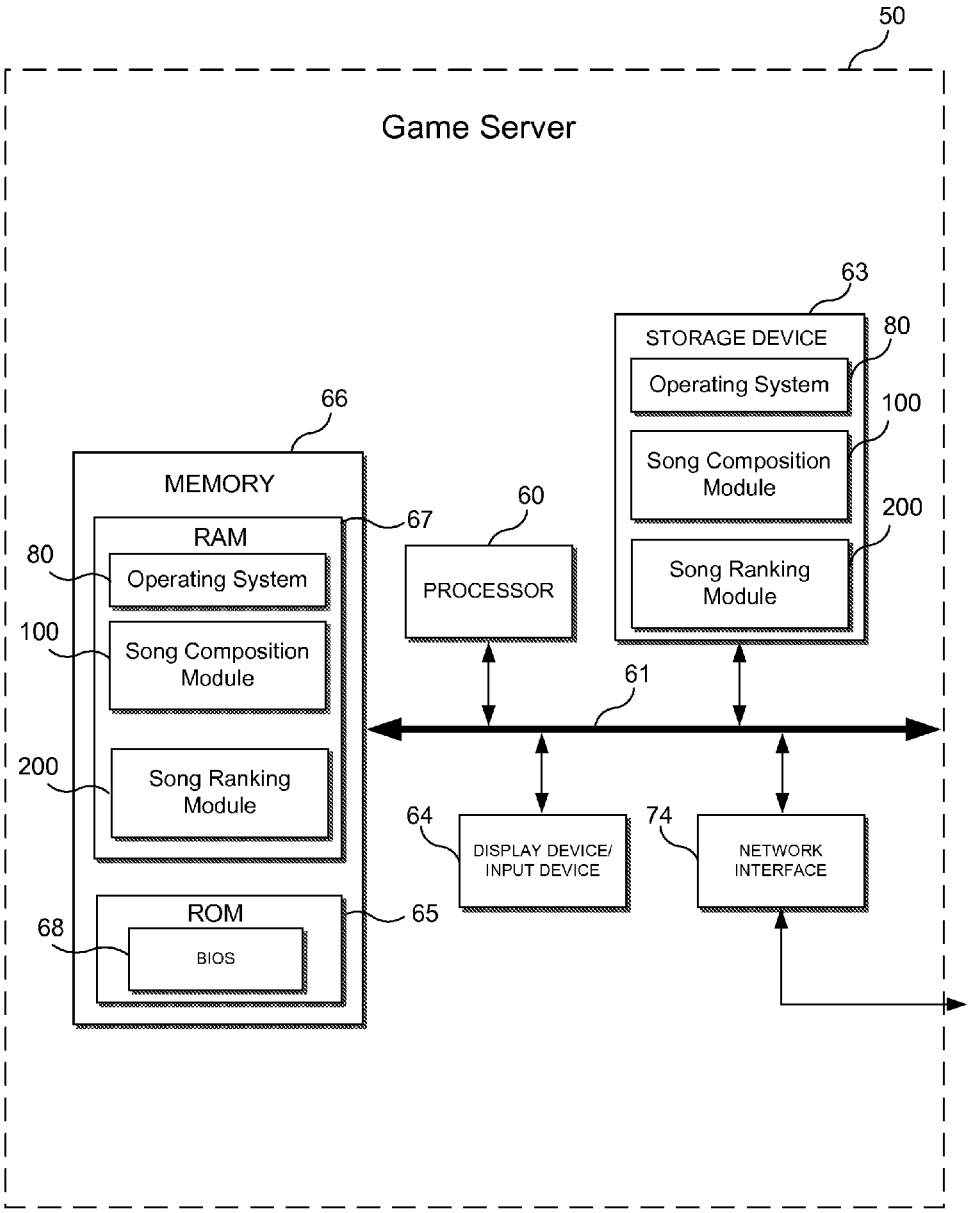
FIG. 2 is a schematic diagram of the Game Server of FIG. 1.
Figure 3:
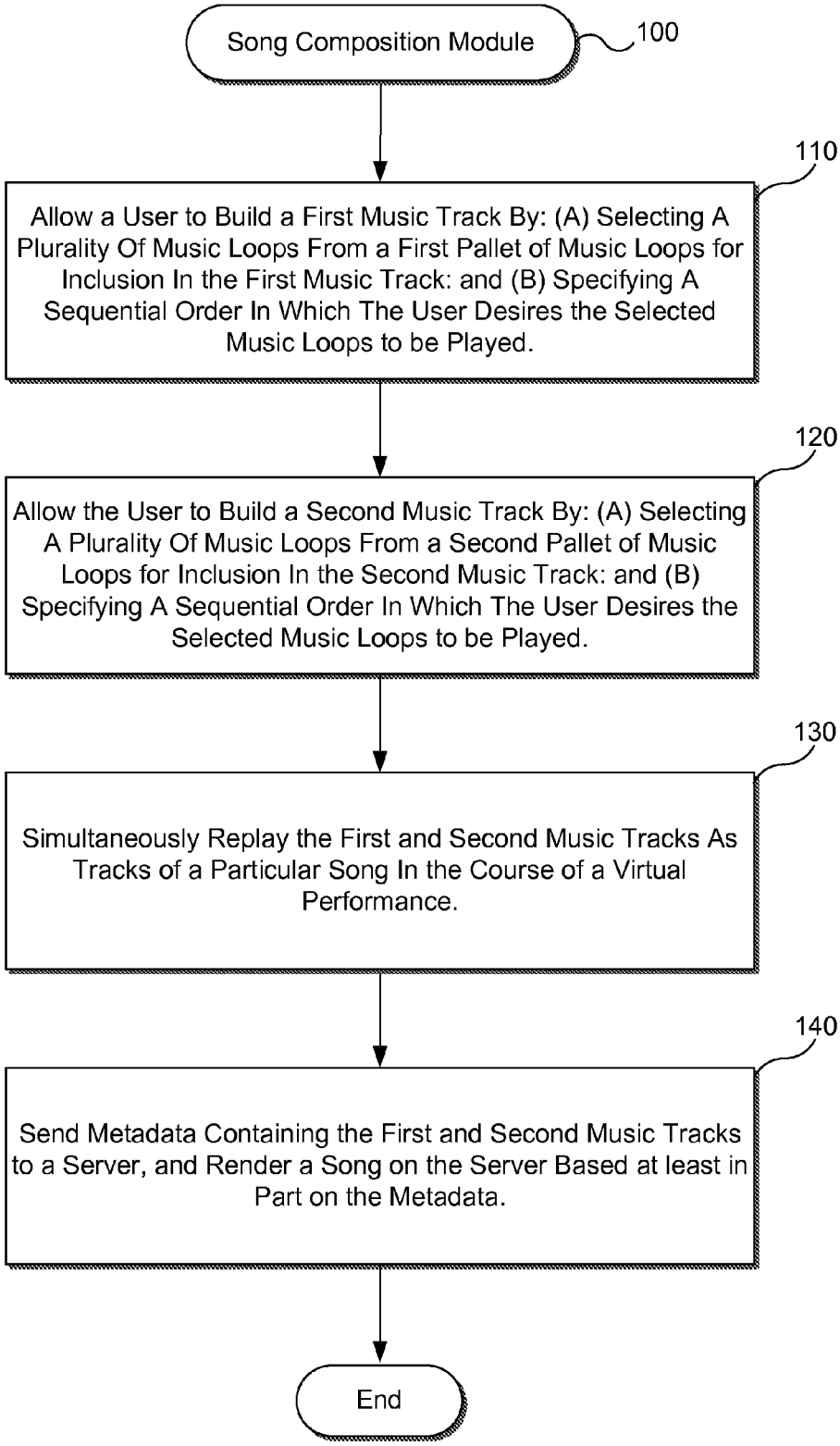
FIG. 3 is a flowchart that generally illustrates the operation of a Song Composition Module according to a particular embodiment.

FIG. 2 shows a block diagram of an exemplary embodiment of the Application Server 30 of FIG. 3. The application Server 30 includes a processor 60 that communicates with other elements within the Application Server 30 via a system interface or bus 61. Also included in the Application Server 30 is a display device/input device 64 for receiving and displaying data. This display device/input device 64 may be, for example, a keyboard, voice recognition, or pointing device that is used in combination with a monitor. The Application Server 30 further includes memory 66, which preferably includes both read only memory (ROM) 65 and random access memory (RAM) 67. The server's ROM 65 is used to store a basic input/output system 68 (BIOS) that contains the basic routines that help to transfer information between elements within the Application Server 30.

In addition, the Application Server 30 includes at least one storage device 63, such as a hard disk drive, a floppy disk drive, a CD Rom drive, or optical disk drive, for storing information on various computer-readable media, such as a hard disk, a removable magnetic disk, or a CD-ROM disk. As will be appreciated by one of ordinary skill in the art, each of these storage devices 63 is connected to the system bus 61 by an appropriate interface. The storage devices 63 and their associated computer-readable media provide nonvolatile storage for the Application Server 30. It is important to note that, in various embodiments, the computer-readable media described above could be replaced by any other type of computer-readable media (e.g., magnetic cassettes, flash memory cards, digital video disks, and Bernoulli cartridges).

A number of program modules may be stored by the various storage devices and within RAM 67. Such program modules include an operating system 80 and a Song Composition Module 100 and a Song Ranking Module 200. The Song Composition Module 100 and Song Ranking Module 200 control certain aspects of the operation of the Game Server 30, as is described in more detail below, with the assistance of the processor 60 and an operating system 80.

Also located within the Application Server 30 is a network interface 74 for interfacing and communicating with other elements of a computer network. It will be appreciated by one of ordinary skill in the art that one or more of the Application Server 30 components may be located geographically remotely from other Application Server 30 components. Furthermore, one or more of the components may be combined, and additional components performing functions described herein may be included in the Application Server 30.

Figure 4:
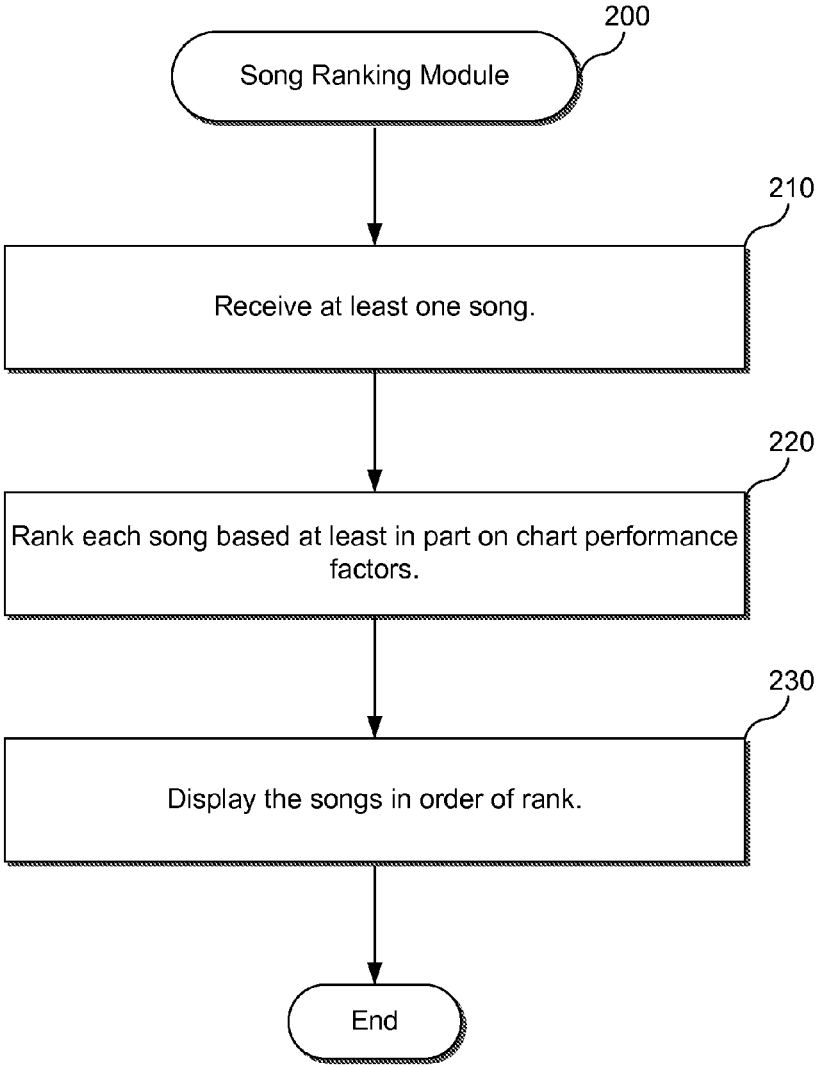
FIG. 4 is a flowchart that generally illustrates the operation of a Song Ranking Module according to a particular embodiment.

As noted above, various aspects of the system's functionality may be executed by certain system modules, including the system's Song Composition Module 100 and Song Ranking Module 200. Exemplary steps performed by these modules are shown in FIGS. 3 and 4.

Exemplary System Architecture

As noted above, various aspects of the system's functionality may be executed by certain system modules, including the system's Song Composition Module 100 and Song Ranking Module 200. These modules are discussed in greater detail below.

Song Composition Module

FIG. 3 is a flow chart of an exemplary Song Composition Module 100. As may be understood from FIG. 3, certain embodiments of the Song Composition Module 100 are configured to allow a user to compose songs that contain music tracks created by a music loop from a pallet of available music loops, and specifying the sequential order in which the selected music loops are to be played.

The system begins at Step 110 by allowing a user to build a first music track by (A) selecting a plurality of music loops from a first pallet of music loops for inclusion in the first music track; and (B) specifying a sequential order in which the user desires the selected music loops to be played. In particular embodiments, individual music loops comprise musical loops containing a single particular instrument (e.g., drums, keyboard, bass, vocals, guitar, etc.). In other embodiments, music loops comprise different instruments or sounds and/or multiple instruments or multiple sounds. For example, a particular loop may be a vocal loop, a lead loop (e.g., which may include both guitar and piano music), a bass loop, or a drum loop. In various embodiments, a lead loop may include instruments that play notes that are typically at a relatively high frequency (e.g., guitar, piano, violin, etc.), while a bass loop may include instruments that typically play notes that are at a relatively low frequency (e.g., a bass guitar, cello, etc.). In other embodiments, music loops may contain any other suitable sounds (e.g., sounds other than sounds created by an instrument) for inclusion in a song.

In various embodiments, each of the plurality of music loops in a particular pallet is of at least about the same length, contains music of at least about the same tempo, and/or contains music of the same general musical style as the other loops in the pallet (e.g., country music, rock music, alternative music, electronic music, rap music, etc.). In particular embodiments, the system is configured to allow a user to select from a plurality of pre-recorded music loops. In other embodiments, the system is configured to allow a user to record his or her own music loops (e.g., using a virtual instrument via an on-screen interface, using a real instrument and recording the instrument using a microphone, or in any other suitable manner).

The system continues, at Step 120, by allowing a user to build a second music track by (A) selecting a plurality of music loops from a second pallet of music loops for inclusion in the second music track; and (B) specifying a sequential order in which the user desires the selected music loops to be played. In various embodiments, the system is configured to allow the user to create any number of music tracks (e.g., up to five music tracks) for inclusion in a complete song. In particular embodiments, any individual music track may comprise distinct instruments (e.g., the instrument on a first music track may include guitar, and the instrument on a second music track may include drums, etc.). In various embodiments, all of the music tracks comprise music of the same genre (e.g., country, rock, hip hop, rhythm and blues, alternative, electronic, etc.). In other embodiments, the music tracks comprise cross genre music (e.g., music from more than one genre such as hip hop and electronic, rock and electronic, etc.).

The system then, at Step 330, simultaneously replays the first and second music tracks as tracks of a particular song in the course of a virtual performance. As a particular example, if the first music track were drum music and the second music track contained guitar music, the system would replay the guitar and drum music simultaneously to form a single song (e.g., by starting the playback of the first and second music tracks at the same time). The system may replay the particular song at the request of the user, or may substantially automatically (e.g., automatically) play the song once the music tracks are all completed by the user.

In various embodiments, the system continues, at Step 140 by sending metadata containing the first and second music tracks to a server, and renders a song on the server based at least in part on the metadata. In various embodiments, the server is a computer other than the device used by the user to access the system (e.g., such as a centralized game server such as the game server 30 shown in FIG. 1). In particular embodiments, the system stores a copy of the rendered song (e.g., as an MP3 or similar file) on the server. In particular embodiments, the system is configured to allow users to share rendered songs (e.g., such as the rendered songs stored on the server) with others (e.g., other users, friends, etc.).

Song Ranking Module

FIG. 4 is a flow chart of an exemplary Song Ranking Module 200. As may be understood from FIG. 4, the Song Ranking Module 300 is configured to rank user-created songs (e.g., by popularity) against songs created by other users. The Song Ranking Module 200 is then configured to display the ranked songs to users of the system.

When executing this module, the system begins at Step 210 by receiving at least one song. In various embodiments, the at least one song is a song created by a user, e.g., using the Song Composition Module described above. In particular embodiments, the system, at Step 210, receives songs created by a plurality of users (e.g., all users of the system). The system may receive songs, for example, when those songs are shared by particular users of the system, when the songs are rendered (e.g., on the system server as described above), or through any other suitable mechanism.

The system continues at Step 220 by ranking the songs received at Step 210 based at least in part on one or more chart performance factors. Chart performance factors may include, for example, social activity, which may by measured by the number a times a particular song has been shared (e.g., via Facebook, Twitter, e-mail, text message, or other social networking site or suitable sharing method). Chart performance factors may further include a number of times a particular song has been downloaded or saved by various users of the system, a number of impressions (e.g., views or listens, shares or 'likes' in the context of the application itself or on various social networks such as Facebook) of the particular songs by various users of the system (e.g., or others with whom the songs have been shared), and a number of times the song has been played (e.g., including whether the song was played all the way through, paused during playback, or only partially played).

The system continues, at Step 230, by displaying the songs in order of the ranking determined at Step 220. The system may display the songs in order of ranking on any suitable device (e.g., a mobile device, personal computer, laptop, tablet etc.).

Exemplary User Experience

The operation of exemplary embodiments of the Song Composition Module 100, Sharing Module 200, and Song Ranking Module 300 are perhaps best understood by reviewing particular examples. The following examples describe the experience of the user within each module.

Song Composition Experience

Figure 5:
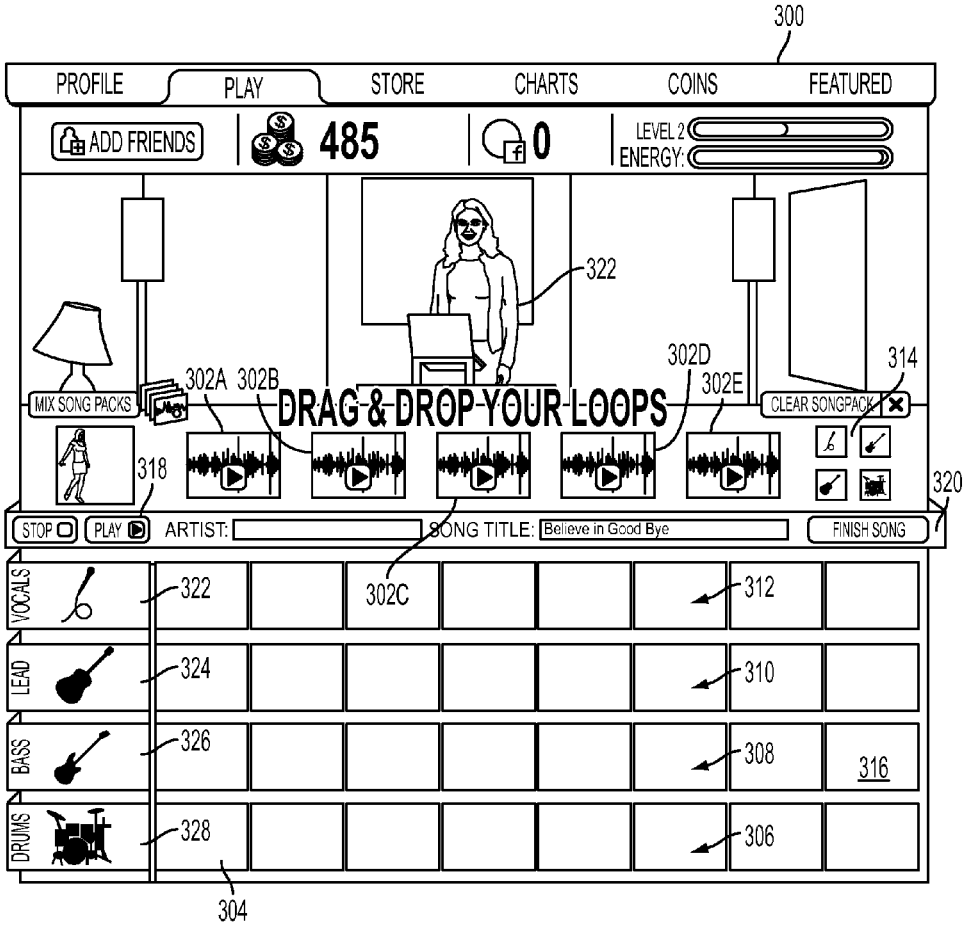
FIGS. 5-9 are user interfaces of a game system according to particular embodiments.

In particular embodiments, application systems are played, for example, on a user's computer (desktop or laptop), tablet, or phone (e.g., in a browser on any of these various devices). First-time users to the application system may begin their experience by composing a song. In various embodiments, users chose from four available "song packs" that represent four music genres, such as hip hop, country, rock, and techno. In other embodiments, users choose from any number of available song packs from any number of genres or music styles. As shown in FIG. 5, song packs may include one or more Track Selectors 314 for vocals and a plurality (e.g., at least three) default instruments, such as drums, lead guitar, and bass guitar, which may be combined, for example, to form a full band. In various embodiments, each Track Selector 314 contains up to five loop patterns 302 that agree with each other in tempo, style, and length, which may, for example, be usable to compose a cohesive song. In particular embodiments, the system may allow a user to select from any number of loop patterns 302.

In particular embodiments, a plurality of music icons or text appear in the Track Selector 314. Users begin by selecting (e.g., clicking on) an instrument or sound (e.g., such as vocals 322, lead 324, bass 326, or drums 328) in the Track Selector 314. Loops 302A-E available for the selected instrument appear above the Song Grid 316. Users can listen to a preview of each music loop (e.g., by selecting the loop), and drag and drop loops to the appropriate music track 304-312 on the Song Grid 316. At any point during song composition, users can preview the song as it has been created so far, for example, by selecting a Play button 318.

As an example, a user creating a song begins by creating the drum track. The user clicks the drum icon 328 in the Track Selector 314, and five available drum loops 302 appear above the Song Grid 316. The user can hear a preview of a drum loop by clicking the loop 302. After deciding on a drum loop, the user drags the desired loop and drops in into an available space 304 on the drum track 306. As may be understood from FIG. 5, each space 304 is a segment of time within the track (e.g., drum track 306). The segments of time combine to make each individual track (e.g., each space 304 in the drum track 306 combines to make the complete drum track 306) and have a length that is substantially similar (e.g., the same as) a length of time of the various instrument loops. The user repeats this process until all time segments (e.g., spaces 304) on the drum track 306 that the user desires to fill are filled. At any point during this process, the user can click the Play button 318 to hear a preview of the drum track.

The user may repeat this process to finish creating tracks for the remaining instruments (e.g., vocals, guitar, and bass). Tracks may be finished when the user has placed an instrument loop in each available space 304 (e.g., time segment) in the music track. When this step is complete, the user can click Play 318 to review the completed track. During play back, each of the corresponding tracks for the various instruments are played substantially simultaneously (e.g., simultaneously) so that they begin at substantially the same time (e.g., the same time) and so that each of the respective loops within each track begins and ends at substantially the same time (e.g., the same time). If the user wants to edit any of the tracks, the user can delete loops or move them to different positions within the appropriate track by repositioning the loops within the track, placing a new loop in a desired space 304 (e.g., time segment) within the track, etc.

When the user is satisfied with the composed song, the user may click the Finish Song button 320 to render the song. In various embodiments, rendering the song includes creating a single song file (e.g., an MP3, etc.) that contains the music tracks and loops as arranged by the user. At this point the browser passes song metadata to a server, which then uses the metadata to render the song. The metadata may include, for example, information about the placement by the user of various loop patterns 302 in particular locations within the Song Grid 316. In particular embodiments, the metadata includes, for each track, the identification of the instrument loop that the user has selected to play within each individual time segment. The server uses the metadata to render the song by creating a song file (e.g., an MP3) that includes all of the instrument loops in their respective positions within each music track. The rendered song is saved on the server for later playback and sharing by the user who composed the song, or by other users.

After rendering the song, the system may ask the user if the user wishes to play the song. In particular embodiments, the user chooses an avatar 322 and a venue in which the user can play the song, or perform a gig that includes multiple songs.

Figure 6:
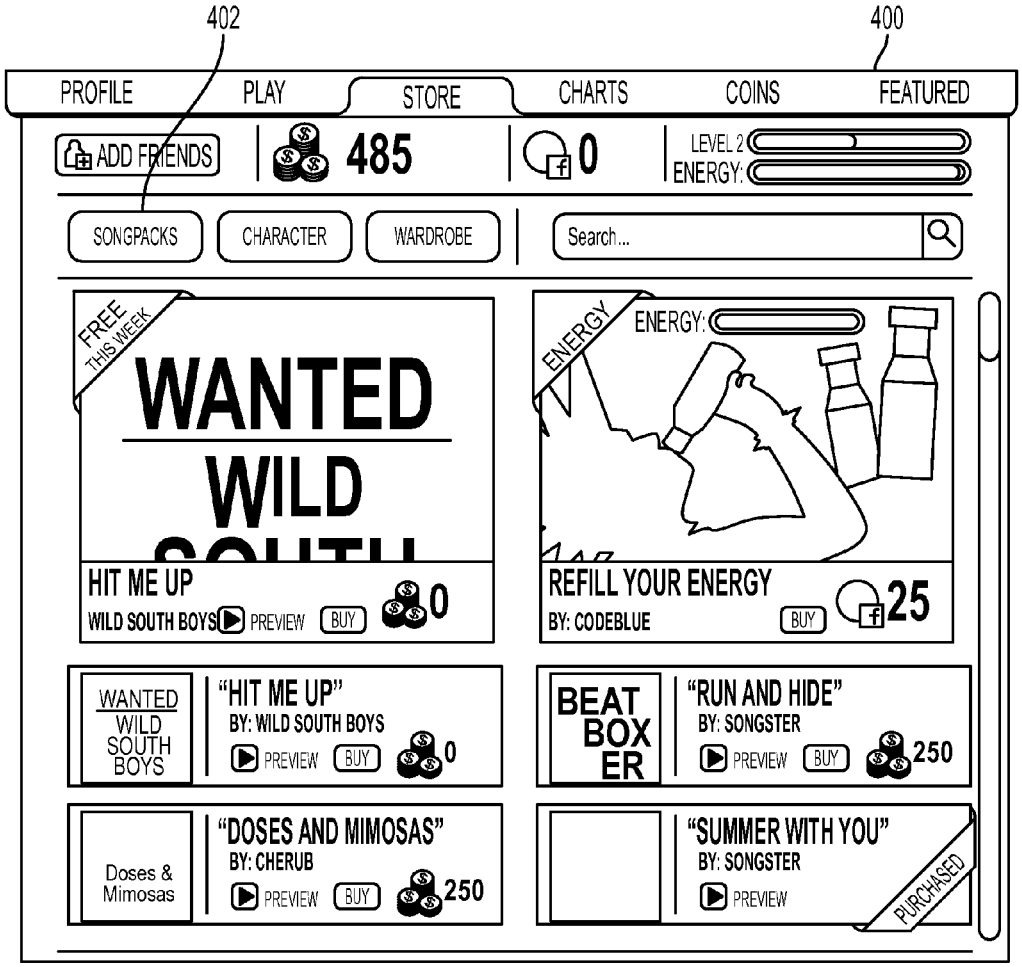
Figure 7:
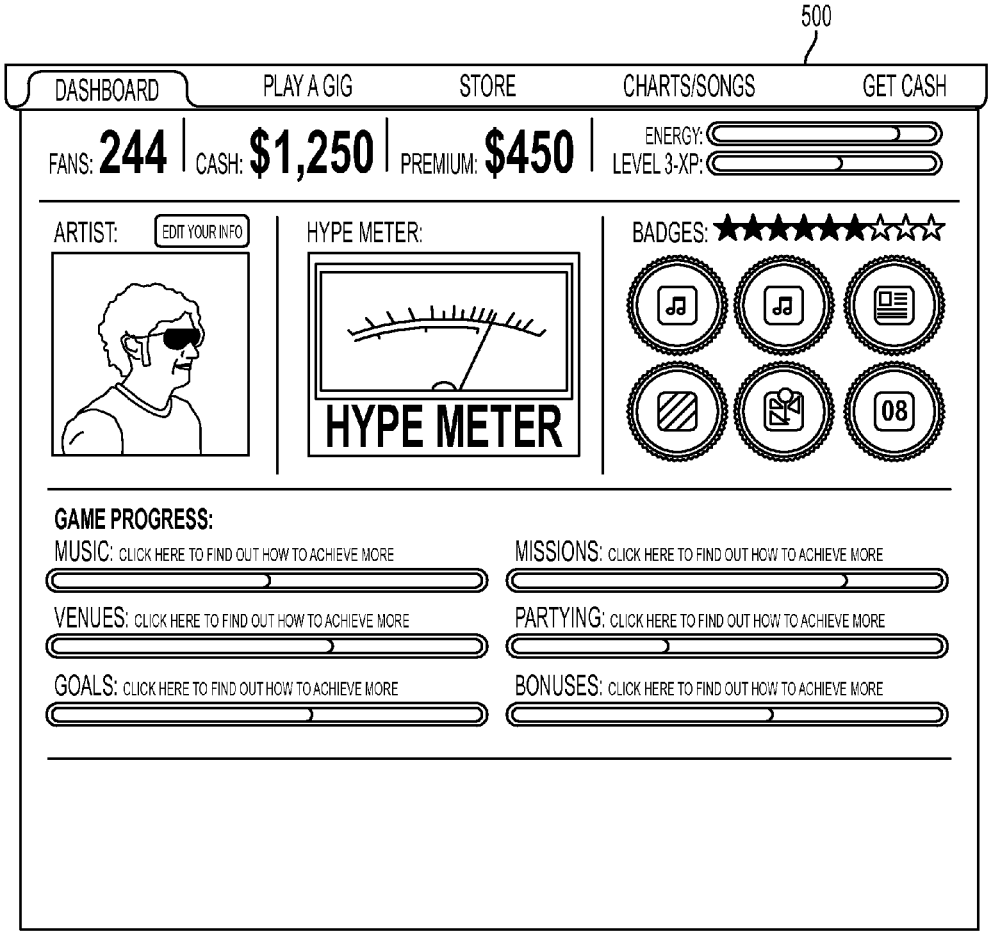

After playing the gig, the user can compose new songs, either with song packs that are currently available to the user, or with song packs that the user may purchase in an on-line store 400 such as the store shown in FIG. 6. As the user repeats the process of composing songs and playing gigs, the user's level in the game may increase, and the number of song packs 402 and instruments available to the user, both in the game and for purchase from the store 400, may increase as well. In various embodiments, users can track their progress within the game via a User Dashboard 500, such as the dashboard shown in FIG. 7.

In certain embodiments, after a user reaches a predefined level in the game, the user may import existing songs, such as current pop songs, into the game and create music loops from those songs.

In certain embodiments, users are able to add bandmates (e.g., up to five bandmates), thus allowing them to collaborate by having each bandmate compose one or more separate tracks of the same song. In various embodiments, the bandmates may compose the song asynchronously or at the same time.

Song Sharing Experience

Figure 8:
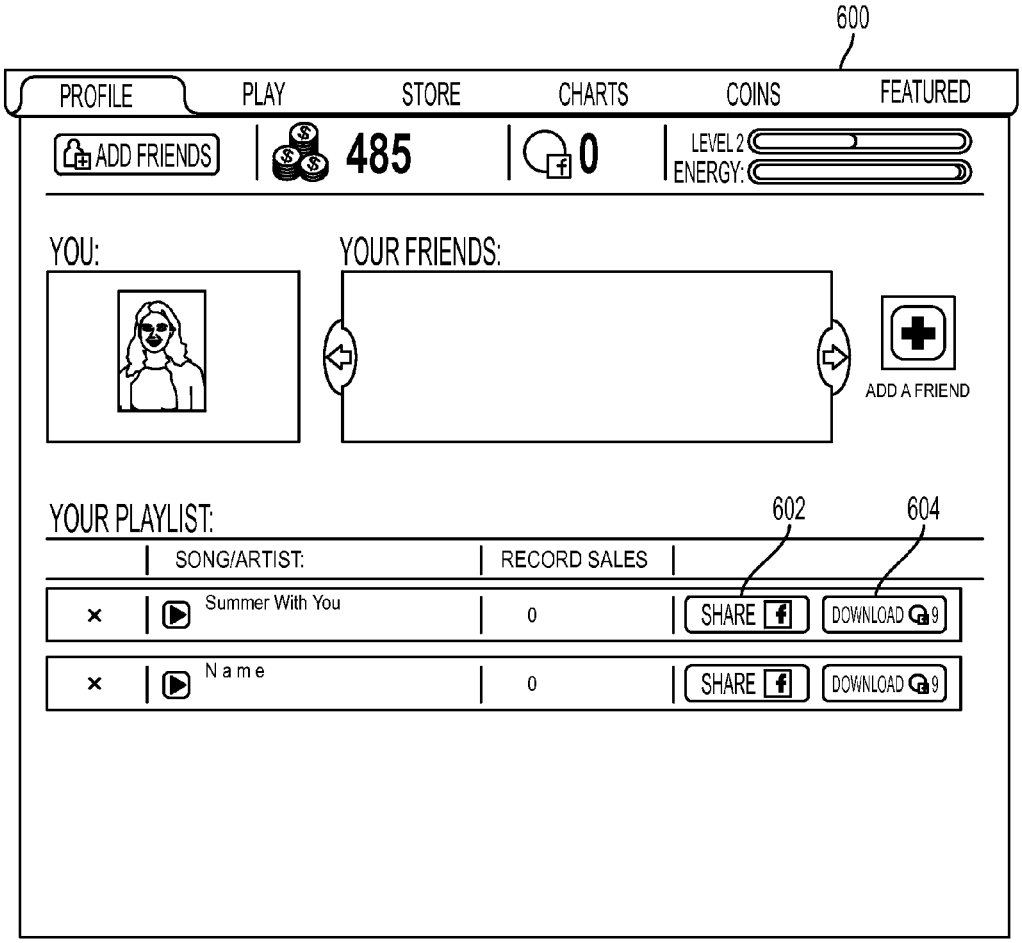

In various embodiments, after rendering songs and playing gigs, users can share songs with other members of the game community, members of various social networking sites (e.g., Facebook, Twitter, etc.), or with friends or others via e-mail, text message, etc. As shown in FIG. 8, users may share songs from their profile by clicking a Share button 602. In response to a user sharing a song, the system may place the song on a chart, where the system ranks the song against other shared songs. In various embodiments, the system may be adapted to enable other users, such as bandmates, to revise songs (e.g., edit the songs by adjusting the placement of various instrument loops within the song, etc.). In particular embodiments, community members can download shared songs as .MP3 files, which may be available for no charge or for a particular cost determined by either the system or the user. Users may use the Download button 604 to download an .MP3 copy of their songs that they can share with people outside of the community, or copy onto portable devices (e.g., smart phones, MP3 players, etc) to listen to when not accessing the system. In various embodiments, users can perform songs in front of other users to gain virtual rewards.

In particular embodiments, the system may be adapted to monitor the number of times that the song is accessed, played back, edited, etc. . . . via, for example, a suitable client or server application. This information may be used, for example, in the context of the song ranking experience described below.

Song Ranking Experience

Figure 9:
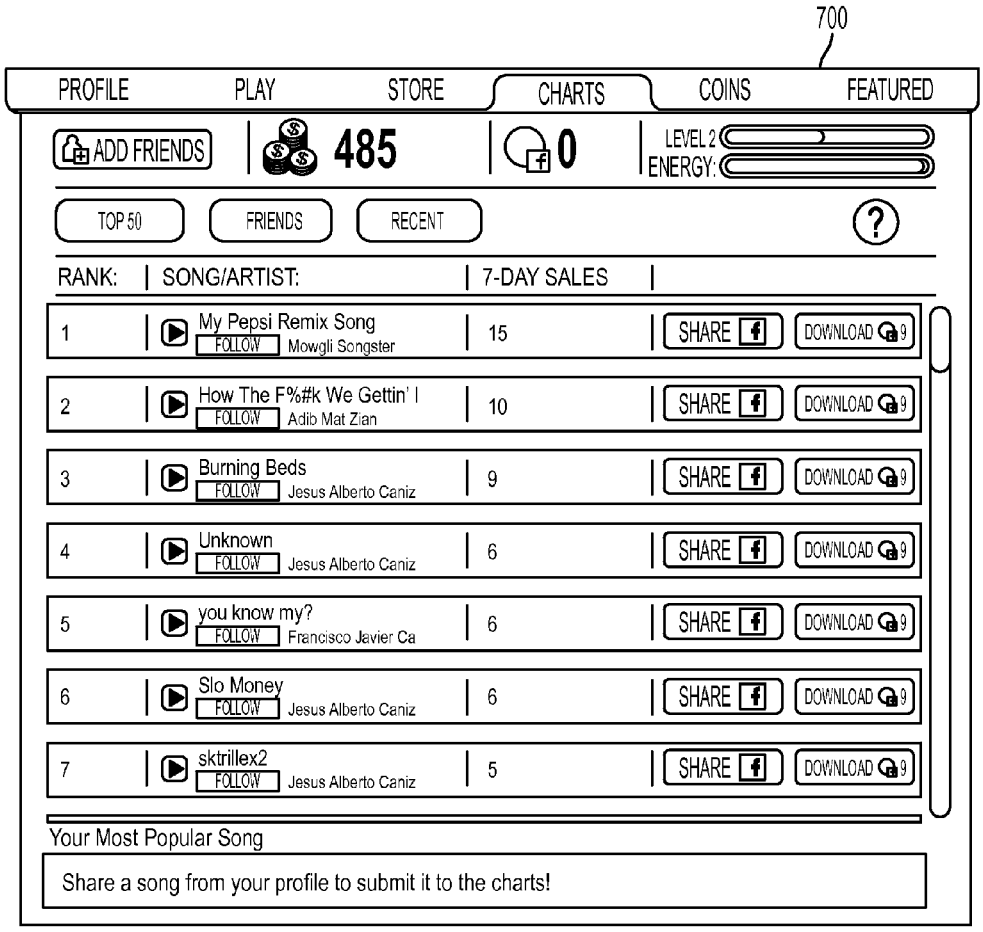

In various embodiments, after a user shares a song, the system places the song on one or more "charts". FIG. 9 illustrates an example of a chart 700 that shows songs in order of rank. The system may rank the songs on the chart based on any of the chart performance factors discussed more fully above. Community members can play, share, and download songs directly from the chart 700. The system may adjust the charts according to any suitable predetermined schedule (e.g., daily, pulling statistics from the previous seven days to compute rankings).

As the user's song moves up the rankings in the chart, the user may receive virtual rewards. These achievements may cause the system to unlock more functionality within the game, such as the ability to: (1) buy more song packs, (2) add instruments and band members, and (3) play gigs in additional (e.g., progressively larger) venues. The user can refer to the system dashboard 500, shown in FIG. 9, to monitor game progress and to obtain tips on increasing hype for their band.

Alternative Embodiments

Various embodiments of the gaming system may include features or functionality that differs or is in addition to the functionality described above.

Mixed Song Packs

In various embodiments, the gaming system allows users to mix song packs together, creating a cross-genre mix-up. In particular embodiments, the application uses an algorithm that shifts the key and tempo of song packs to make the respective loops within the song packs compatible (e.g., shifts one song pack into a key and tempo that is musically compatible with another song pack). For example, in various embodiments, it may be possible to create a song using instrument loops from both a song pack in the electronic genre in the key of 'E" at 160 beats per minute (BPM) and a song pack in the country music genre in the key of 'G' sharp at 100 BPM.

Substantially Automatic Song Creation

In some embodiments, the application combines artificial intelligence (AI) and/or business intelligence (BI) in a randomized feature that uses popular patterns to generate song packs. The AI portion predicts song packs and loops that are compatible (e.g., song packs and instrument loops that will sound good together), while the BI portion uses a user's past song preference to predict what the user will like in terms of auto-generated songs (e.g., by choosing genres of music that the user frequently rates highly).

In some embodiments, the application tracks the types of songs people have produced in the past and use that BI to identify song packs that the user might like. For example, the system may assign a rating to particular music genres, such as a 5 for hip hop and a 2 for electronica. Based on these ratings, the system may substantially automatically identify song packs for the user that are heavy in hip hop with an electronica flavor.

User-Provided Instrument Loops

In particular embodiments, the system is configured to allow users to provide their own instruments loops. In certain embodiments, users can record real instruments (e.g., using a microphone, MIDI-compatible musical instrument, computer, or mobile device) to create instrument loops that may be combined with other user created instrument loops or system provided instrument loops. In particular embodiments, users can share their user-created instrument loops with other users, and the other users may incorporate those loops into songs of their own. In various embodiments, the system is adapted to allow users to create instrument loops using virtual instruments, for example, using an on-screen keyboard, drum pad, or similar virtual instrument. In a particular embodiment, users can use a device containing an accelerometer (e.g., a smart phone) to substantially simulate (e.g., simulate) an instrument or a sound such as a maraca, tambourine, shaker, etc.

Collaborative Song-Writing

In particular embodiments, the system is configured to allow one or more users to collaborate to create a single song. In various embodiments, the system is configured to allow users to each compile different music tracks to create a single song. For example, a first user may assemble an music track for the guitar, while another user may assemble the music track for the drums. The system then combines the drum and guitar tracks assembled by the two users to render a complete song.

Progressive Complexity

In various embodiments, the system is configured to provide the user with more advanced content (e.g., more complicated instrument loops) for use in creating songs as the user progresses in the game. The user may progress in the game, for example, by creating a particular number of songs (e.g., to gain more experience with song creation), sharing a particular number of songs, playing a particular number of gigs, etc. In various embodiments, the system is configured to allow users with greater musical acumen (e.g., users whose songs have a high ranking, users with higher progression levels within the game, etc.) to create more advanced songs (e.g., songs with more tracks, songs with more complicated loops, etc.).

Loop Timing and Alignment

In particular embodiments, music loops may contain metadata that identifies and labels the timing of each musical beat as well as the musical meter and tempo of the music loop. In various embodiments, music loops may be in a compatible tempo but contain a different number of musical beats. These loops of differing lengths can be mixed by aligning the musical beats and measures instead of simply aligning the beginning and end time of each music loop. In such embodiments, users can build tracks using music loops that contain different numbers of musical beats.

In particular embodiments, the system is configured to substantially automatically (e.g., automatically) place a loop that has pre and/or post audio at a musically compatible moment in time (e.g. a vocal loop that has pre audio of the vocalist taking a breath before the first beat may be placed so the first beat aligns with the first beat of another loop).

Conclusion

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended exemplary concepts. Although specific terms are employed herein, they are used in a generic and descriptive sense only and not for the purposes of limitation.

We claim:

1. A non-transitory computer-readable medium storing computer-executable instructions that when executed by a computer processor cause said computer processor to:

(A) allow a user to build a first music track by: (i) selecting a first plurality of music loops from a first pallet of music loops for inclusion in the first music track: and (ii) specifying a sequential order in which the first plurality of music loops is to be played;

(B) allow said user to build a second music track by: (i) selecting a second plurality of music loops from a second pallet of music loops for inclusion in the second music track: and (ii) specifying a sequential order in which the second plurality of music loops is to be played; and (C) substantially simultaneously play said first and second music tracks as tracks of a particular song, wherein said first pallet of music loops comprises sounds in a first particular frequency range, which is different from a second particular frequency range of said second pallet of music loops.

2. The non-transitory computer readable medium of claim 1, wherein said second pallet of music loops comprises sounds in a second particular frequency range.

3. The non-transitory computer-readable medium of claim 1, wherein said first music track comprises a plurality of time segments, said time segments having a length of time that is substantially similar to a length of time of said music loops in said first pallet of music loops.

4. The non-transitory computer-readable medium of claim 3 wherein said second music track comprises a plurality of time segments, said time segments corresponding to said time segments of said first music track.

5. The non-transitory computer-readable medium of claim 1, wherein said computer-executable instructions when executed by said computer processor cause said computer processor to substantially simultaneously play said first and second music tracks such that said first and second music tracks begin and end at substantially a same time.

6. The non-transitory computer-readable medium of claim 4, wherein said computer-executable instructions when executed by said computer processor cause said computer processor to substantially simultaneously play said first and second music track such that said time segments of said first music track begin and end at substantially a same time as said corresponding time segments of said second music track.

7. The non-transitory computer readable medium of claim 1, further storing computer-executable instructions when executed by said computer processor cause said computer processor to:

(D) allow a second user to build a third music track by: (i) selecting a third plurality of music loops from a third pallet of music loops for inclusion in the third music track: and (ii) specifying a sequential order in which the third plurality of music loops is to be played; and (E) substantially simultaneously play the first, second, and third music tracks as tracks of said particular song.

8. The non-transitory computer-readable medium of claim 7, wherein said third pallet of music loops comprises sounds from a third particular frequency range that differs from the first particular frequency range of sounds from said first pallet of music loops.

9. The non-transitory computer-readable medium of claim 1, wherein said first and second pallets of music loops comprise music from an instrument selected from a group consisting of:

(A) guitar music;

(B) bass guitar music;

(C) piano music;

(D) drum music; and (E) vocal music.

10. The non-transitory computer-readable medium of claim 1, wherein said first pallet of music loops comprises music from a first genre, and said second pallet of music loops comprises music from a second genre.

11. The non-transitory computer-readable medium of claim 10, wherein said first and second genres are selected from a group consisting of:

(A) rock music;

(B) country music;

(C) electronic music;

(D) hip hop music; and (E) alternative music.

12. The non-transitory computer-readable medium of claim 1, further storing computer executable instructions when executed by said computer processor cause said computer processor to:

(D) send metadata to a server, said metadata comprising said first music track and said second music track; and (E) render a song based at least in part on said metadata.

13. The non-transitory computer-readable medium of claim 12, further storing computer-executable instructions when executed by said computer processor cause said computer processor to:

(F) store said rendered song on said server.

14. The non-transitory computer-readable medium of claim 13, further storing computer-executable instructions when executed by said computer processor cause said computer processor to:

(G) allow said user to share said stored song with one or more other users.

15. A computer system comprising:

at least one computer processor configured to:

allow a user to build a first music track by: (i) selecting a first plurality of music loops from a first pallet of music loops for inclusion in the first music track: and (ii) specifying a sequential order in which the first plurality of music loops is to be played;

allow allowing said user to build a second music track by: (i) selecting a second plurality of music loops from a second pallet of music loops for inclusion in the second music track: and (ii) specifying a sequential order in which the second plurality of music loops is to be played; and render a song based at least in part on said first music track and said second music track, wherein said first pallet of music loops comprises sounds in a first particular frequency range, which is different from a second particular frequency range of said second pallet of music loops.

16. The computer system of claim 15, wherein said at least one computer processor is further configured to:

rank said rendered song and at least one other song based at least in part on one or more chart performance factors; and display said rendered song and said at least one other song based at least in part on said ranking.

17. The computer system of claim 16, wherein said one or more chart performance factors are selected from a group comprising:

(a) a number of times said rendered song has been shared;

(b) a number of times said rendered song has been played; and (c) a number of time said rendered song has been downloaded.

18. The computer system of claim 15, wherein said at least one computer processor is further configured to allow said user to share said rendered song with one or more other users.

19. A non-transitory computer-readable medium storing computer-executable instructions that when executed by a computer processor cause said computer processor to:

(A) provide an interface to a user for allowing said user to build one or more music tracks;

(B) receive, from said user, a selection of one or more music loops from one or more pallets of music loops for inclusion in each of said one or more music tracks;

(C) send metadata to a server, said metadata comprising said one or more music tracks; and (D) render a song based at least in part on said metadata, wherein at least one pallet of said one or more pallets of music loops comprises sounds in a particular frequency range, which is different from a second particular frequency range of a second pallet of music loops.

20. The non-transitory computer-readable medium of claim 19, further storing computer executable instructions that when executed by said computer processor cause said computer processor to:

(E) provide said user with said one or more pallets of music loops based at least in part on a progression level of said user.

21. The non-transitory computer-readable medium of claim 20, wherein:

said interface allows said user to render a plurality of songs; and said progression level of said user is based at least in part on a number of songs rendered by said user.

22. The non-transitory computer-readable medium of claim 19, wherein said one or more pallets of music loops are user-created instrument loops.

23. The non-transitory computer-readable medium of claim 19, wherein said user is a first user, and said non-transitory computer-readable medium further stores computer-executable instructions that when executed by said computer processor cause said computer processor to:

(E) provide said interface to a second user for allowing said second user to build one or more music tracks, wherein:

said metadata comprises said one or more music tracks built by said first user and said second user.

* * * * *